US012504199B2

(12) United States Patent
Zhou et al.

(10) Patent No.: US 12,504,199 B2
(45) Date of Patent: Dec. 23, 2025

(54) FRESH AIR MODULE AND AIR CONDITIONER

(71) Applicant: GD MIDEA AIR-CONDITIONING EQUIPMENT CO., LTD., Guangdong (CN)

(72) Inventors: Yuanle Zhou, Guangdong (CN); Shuyang Pi, Guangdong (CN); Zhiyong Xu, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 524 days.

(21) Appl. No.: 17/946,294

(22) Filed: Sep. 16, 2022

(65) Prior Publication Data

US 2023/0016042 A1 Jan. 19, 2023

Related U.S. Application Data

(63) Continuation of application No. PCT/CN2020/129244, filed on Nov. 17, 2020.

(30) Foreign Application Priority Data

Mar. 30, 2020 (CN) ..... 202010240347.9

(51) Int. Cl.
*F24F 13/10* (2006.01)

(52) U.S. Cl.
CPC ..... *F24F 13/10* (2013.01)

(58) Field of Classification Search
CPC ..... F24F 13/10
USPC ..... 454/333
See application file for complete search history.

(56) References Cited

U.S. PATENT DOCUMENTS

| | | | | |
|---|---|---|---|---|
| 2,286,749 | A | 6/1942 | Mcelgin | |
| 2007/0227172 | A1* | 10/2007 | Fukumura | F24F 1/005 62/298 |
| 2012/0064817 | A1* | 3/2012 | Choi | F24F 13/20 454/251 |

FOREIGN PATENT DOCUMENTS

| | | | |
|---|---|---|---|
| CH | 658899 | A5 | 12/1986 |
| CN | 101535730 | A | 9/2009 |
| CN | 104406257 | A | 3/2015 |
| CN | 109489123 | A | 3/2019 |
| CN | 209131015 | U | 7/2019 |
| CN | 209181103 | U | 7/2019 |

(Continued)

OTHER PUBLICATIONS

Fujimoto, Tooru, WO2008172609 Translation.pdf, "Air purifier", Jun. 2008, pp. 1-13.*

(Continued)

*Primary Examiner* — Avinash A Savani
*Assistant Examiner* — Ryan L Faulkner
(74) *Attorney, Agent, or Firm* — Scully, Scott, Murphy & Presser, P.C.

(57) ABSTRACT

A fresh air module and an air conditioner are provided. The fresh air module has a housing, a middle partition plate and a fan assembly. The housing is provided with a fresh air duct, which has an air inlet cavity and an air outlet cavity. The middle partition plate is arranged in the fresh air duct, located between the air inlet cavity and the air outlet cavity, and is provided with a ventilation hole that communicates the air inlet cavity and the air outlet cavity. The fan assembly is installed in the air outlet cavity.

15 Claims, 6 Drawing Sheets

(56) References Cited

FOREIGN PATENT DOCUMENTS

| | | | |
|---|---|---|---|
| CN | 209181109 | U | 7/2019 |
| CN | 209181118 | U | 7/2019 |
| CN | 110657492 | A | 1/2020 |
| CN | 111561744 | A | 8/2020 |
| CN | 212132676 | U | 12/2020 |
| JP | 2000249365 | A | 9/2000 |
| KR | 20030006032 | A | 1/2003 |
| WO | 2019223472 | A1 | 11/2019 |

OTHER PUBLICATIONS

Chinese Office Action dated Jun. 25, 2024 received in Chinese Application No. 202010240347.9, together with an English-language translation.
Australian Notice of Acceptance dated Mar. 4, 2024 received in Australian Application No. 2020440046.
International Search Report and Written Opinion dated Jan. 28, 2021 received in International Application No. PCT/CN2020/129244.
Supplementary European Search Report dated Sep. 12, 2023 received in European Patent Application No. EP 20929641.7.
Examination Report No. 1 dated Jul. 31, 2023 received in Australian Patent Application No. AU 2020440046.

* cited by examiner

FRESH AIR MODULE AND AIR CONDITIONER

CROSS REFERENCE TO RELATED APPLICATIONS

This application is a continuation application of PCT International Patent Application No. PCT/CN2020/129244, filed on Nov. 17, 2020, which claims priority to and benefits of Chinese Patent Application No. 202010240347.9, titled "FRESH AIR MODULE AND AIR CONDITIONER" and filed with the Chinese Patent Office on Mar. 30, 2020, the entire contents of which are incorporated herein by reference for all purposes. No new matter has been introduced.

FIELD

This application relates to the field of air conditioners, and in particular, to a fresh air module and an air conditioner.

BACKGROUND

In related technologies, air conditioners on the market are usually equipped with fresh air modules, which may be used to introduce fresh air from outdoor environment into indoor environment to replenish the fresh air of indoor environment and improve the air quality of indoor environment. The conventional fresh air module is usually configured with a fresh air duct in its interior for installing a fan assembly. However, the fresh air duct of this conventional fresh air module is usually an integral and large air cavity, and the wind pressure generated by the fan assembly installed in the fresh air duct is small, resulting in a small fresh air volume output from the fresh air module.

The above contents are only used to assist in understanding the technical solution of this application. Even if the applicant believes that the technology still has some shortcomings and lists it in the background, it does not mean that the applicant admits that this technology is prior art.

SUMMARY

A main object of this application is to propose a fresh air module, which aims to optimize the fresh air duct of the fresh air module and increase fresh air volume output from the fresh air module.

In order to achieve at least the above object, this application provides a fresh air module, comprising:

- a housing configured with a fresh air duct, wherein the fresh air duct comprises an air inlet cavity and an air outlet cavity;
- a middle partition plate arranged in the fresh air duct, located between the air inlet cavity and the air outlet cavity, and provided with a ventilation hole communicating the air inlet cavity and the air outlet cavity; and
- a fan assembly installed in the air outlet cavity.

In an embodiment, the housing comprises a bottom case and a cover that fits and covers the bottom case, and wherein the bottom case is configured with a first cavity, and the middle partition plate is installed at an opening of the first cavity to cooperate with the first cavity to form the air outlet cavity.

In an embodiment, the bottom case is further configured with a second cavity located at one side of the first cavity, and the air inlet cavity is formed between the first cavity and the cover, and wherein the fresh air duct further comprises an air passage cavity between the middle partition plate and the cover, and the ventilation hole of the middle partition plate is communicated with the air inlet cavity by the air passage cavity.

In an embodiment, the fan assembly is installed in the first cavity and includes a centrifugal wind wheel and a first motor, and wherein one end of the centrifugal wind wheel is connected with the first motor, and another end of the centrifugal wind wheel forms an air inlet end and corresponds to the ventilation hole of the middle partition plate.

In an embodiment, the middle partition plate is configured with an air guide ring at a periphery of the ventilation hole, and the air guide ring is extended from the periphery of the ventilation hole toward the air inlet end of the centrifugal wind wheel in a tapered shape.

In an embodiment, the air inlet end of the centrifugal wind wheel is configured with an air induction ring, a constricted end of the air guide ring is extended into the air induction ring, and a clearance gap is formed between an outer peripheral wall of the air guide ring and an inner peripheral wall of the air induction ring for the centrifugal wind wheel to rotate.

In an embodiment, a bottom portion of the bottom case has a motor installation cavity in a direction away from the middle partition plate, and the motor installation cavity is opened toward the first cavity for the first motor to be installed.

In an embodiment, the middle partition plate is configured to form the ventilation hole in a central area of the middle partition plate, to correspond to the air inlet end of the centrifugal wind wheel, and wherein a ratio of a ventilation face area of the ventilation hole of the middle partition plate to a side face area of the middle partition plate is not less than ¼ and not more than ¾.

In an embodiment, a side wall of the bottom case corresponding to the first cavity is provided with a fresh air outlet, and the fresh air outlet is suitable for forward air outlet, and wherein a side wall of the bottom case corresponding to the second cavity is provided with a fresh air inlet, and the fresh air inlet is suitable for air inlet from rear.

In an embodiment, the fresh air module further comprises a temperature sensor, wherein a windward surface of the middle partition plate is configured with a sensor fixing member located at a position of the middle partition plate close to a front air inlet cavity and is suitable for fixing the temperature sensor.

In an embodiment, the fresh air module further includes a purification assembly, wherein the purification assembly is installed on the middle partition plate in a drawable manner along an inner-outer direction of the housing and is located at an air inlet side of the ventilation hole of the middle partition plate.

In an embodiment, the fresh air module further includes a valve assembly, wherein the valve assembly comprises a fresh air door rotatably installed at the fresh air inlet, and a second motor connected with the fresh air door, and wherein the second motor is suitable for driving the fresh air door to turn over to open or close the fresh air inlet.

This application also provides an air conditioner, which includes a casing and a fresh air module installed in the casing. In particular, the casing is provided with an air inlet, a first air outlet and a second air outlet, and in particular, the air inlet is communicated with the first air outlet. The fresh air module includes a housing, a middle partition plate and a fan assembly. The housing is configured with a fresh air duct, and the fresh air duct includes an air inlet cavity and an air outlet cavity. The middle partition plate is arranged in the fresh air duct, is located between the air inlet cavity and the air outlet cavity, and is provided with a ventilation hole which communicates the air inlet cavity and the air outlet cavity. The fan assembly is installed in the air outlet cavity. The air inlet cavity of the fresh air module is suitable for communicating with outdoor environment through a fresh air pipe, and the air outlet cavity of the fresh air module is suitable for communicating with the second air outlet.

In an embodiment, the air conditioner is any one of a wall-mounted air conditioner indoor unit, a cabinet air conditioner indoor unit, an air machine, a ceiling-embedded air conditioner indoor unit, or a mobile air conditioner.

In an embodiment, the casing of the wall-mounted air conditioner indoor unit includes a chassis, a face frame and a panel; the fresh air module is installed at an end of the chassis, and an end of the panel is provided with the second air outlet.

According to the technical solution of this application, the middle partition plate is arranged in the fresh air duct of the fresh air module, so that the fresh air duct is divided into an air inlet cavity and an air outlet cavity, and the air inlet cavity and the air outlet cavity are communicated through the ventilation hole on the middle partition plate, so that for the entire fresh air duct, the volume of the air outlet cavity is smaller than that of the entire fresh air duct. Therefore, when the fan assembly rotates in the air outlet cavity, the fan assembly quickly sucks air from the ventilation hole of the middle partition plate and squeezes it into the air outlet cavity, thus making the air pressure in the air outlet cavity higher, and in turn increasing the rate at which the fan assembly outputs fresh air volume from the fresh air outlet and greatly increasing fresh air volume output from the fresh air module.

BRIEF DESCRIPTION OF THE DRAWINGS

In order to describe technical solutions in the embodiments of this application or in the related art more clearly, accompanying drawings to be used in the description of the embodiments or the related art will be introduced briefly below. Obviously, the accompanying drawings to be described below are merely some embodiments of this application, and a person of ordinary skill in the art may obtain other drawings according to the structures shown in these drawings without any inventive step.

Figure 1:
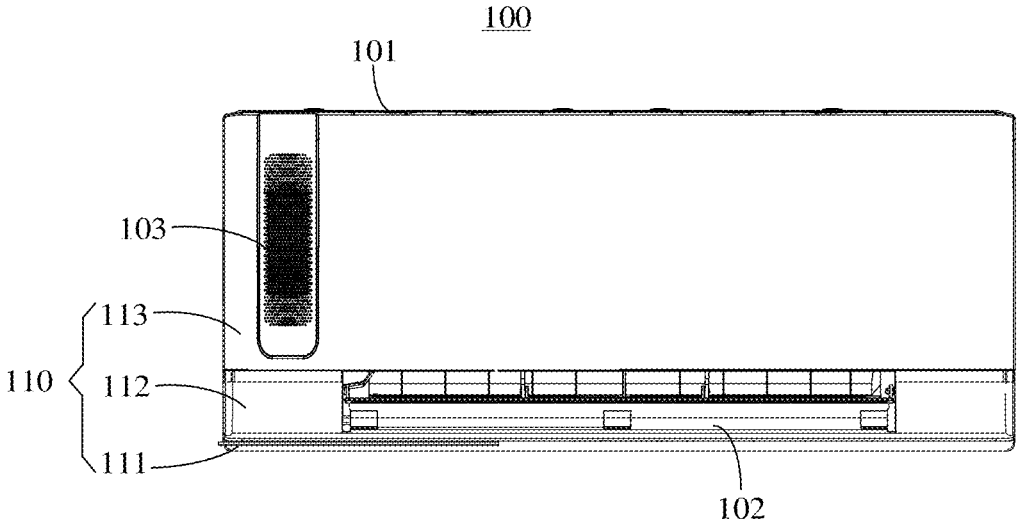
FIG. 1 is a schematic view of an air conditioner according to an embodiment of this application.

Description of reference signs in the figures are provided in the following table.

| reference sign | name | reference sign | name |
|---|---|---|---|
| 100 | air conditioner | 333 | air passage cavity |
| 110 | casing | 301 | fresh air inlet |
| 111 | chassis | 302 | fresh air outlet |
| 112 | frame | 400 | fan assembly |
| 113 | panel | 410 | centrifugal wind wheel |
| 101 | air inlet | 411 | air induction ring |
| 102 | first air outlet | 420 | first motor |
| 103 | second air outlet | 500 | purification assembly |
| 200 | fresh air module | 510 | mounting frame |
| 300 | housing | 520 | purification member |
| 310 | bottom case | 600 | middle partition plate |
| 311 | first cavity | 610 | ventilation hole |
| 312 | second cavity | 611 | air guide ring |
| 313 | motor installation cavity | 620 | sensor fixing member |
| 320 | cover | 700 | valve assembly |
| 330 | fresh air duct | 710 | fresh air door |
| 331 | air inlet cavity | 720 | second motor |
| 332 | air outlet cavity | 800 | fresh air pipe |

The achievement of objects, functional characteristics and advantages of this application will be further explained with reference to the accompanying drawings in combination with the embodiments.

DETAILED DESCRIPTION OF EMBODIMENTS

The technical solutions in the embodiments of this application will be clearly and completely described below with reference to the accompanying drawings in the embodiments of this application. Obviously, the described embodiments are only part of the embodiments of this application, rather than all the embodiments. Based on the embodiments in this application, all other embodiments obtained by those of ordinary skill in the art without inventive step are within the protection scope of this application.

It should be noted that all directional indications, such as up, down, left, right, front and back, in the embodiments of this application are only used to explain the relative positional relationship, movement situation or the like among various components in a certain posture as shown in the accompanying drawings. If the specific posture changes, the directional indications will also change accordingly.

In addition, if there are descriptions such as "first" and "second" in the embodiments of this application, the descriptions such as "first" and "second" in this application are only used for descriptive purposes, and should not be understood as indicating or implying their relative importance or implicitly indicating the number of indicated technical features. Therefore, the features defined with "first" and "second" may include at least one of these features explicitly or implicitly. In addition, the technical solutions of various embodiments may be combined with each other, but which should be based on the implementation for those of ordinary skill in the art. When the combination of technical solutions is contradictory or cannot be implemented, it should be considered that such combination of technical solutions neither exists nor falls within the protection scope of this application.

Referring to FIGS. 1 to 8, a fresh air module 200 and an air conditioner including the fresh air module 200 are provided according to certain embodiments of the disclosure. The dotted arrow in FIG. 5 indicates the flow direction of airflow. The fresh air module 200 may improve and optimize the fresh air duct of the fresh air module 200 to increase the fresh air volume output from the fresh air module 200. The air conditioner may be any one of an indoor unit of a wall-mounted air conditioner, an indoor unit of a cabinet air conditioner, an air machine, an indoor unit of a ceiling-type air conditioner, or a mobile air conditioner. In the following embodiments, the introduction is mainly based on the case where the air conditioner is the indoor unit of the wall-mounted air conditioner indoor unit, which can provide reference for other types of air conditioners.

Figure 2:
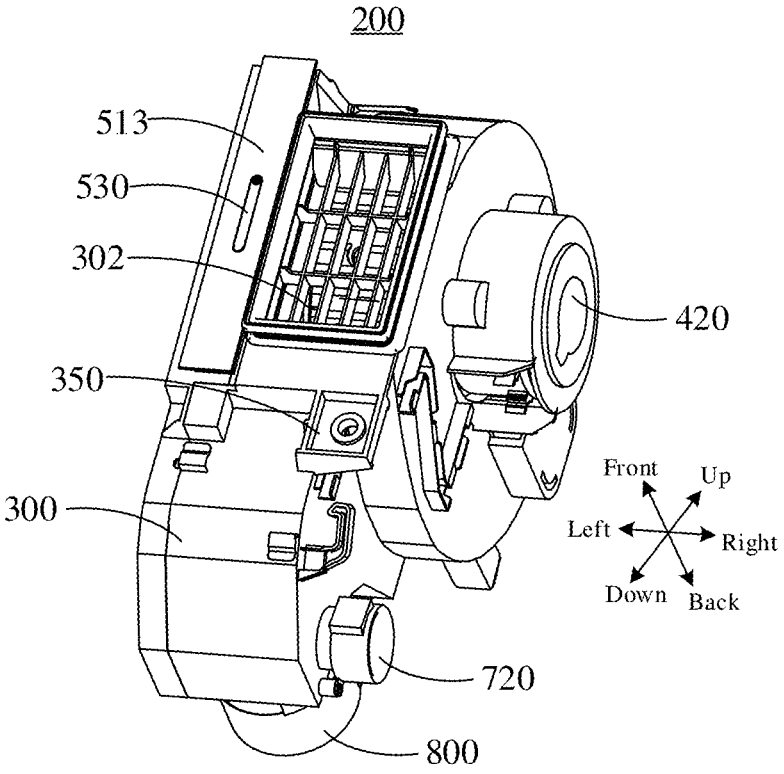
FIG. 2 is a schematic view of a fresh air module according to an embodiment of this application.
Figure 5:
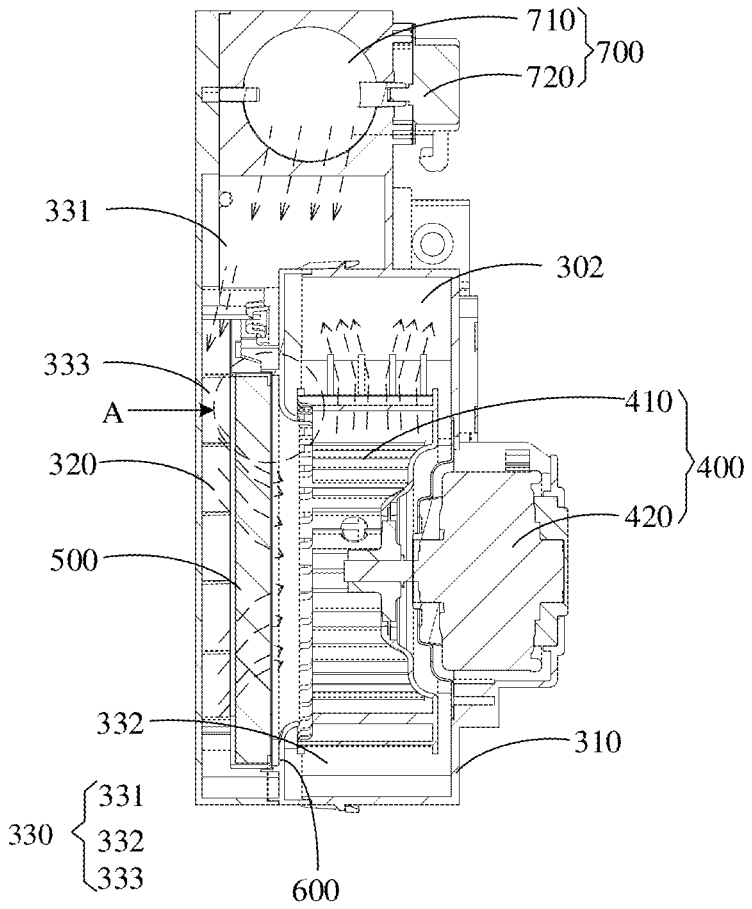
FIG. 5 is a cross-sectional view of the fresh air module in FIG. 3 from another perspective.

Referring to FIGS. 2 and 5, in an embodiment of the fresh air module 200, the fresh air module 200 includes a housing 300, a middle partition plate 600 and a fan assembly 400. The housing 300 defines a fresh air duct 330, which includes an air inlet cavity 331 and an air outlet cavity 332. The middle partition plate 600 is also provided with a ventilation hole 610 which communicates the air inlet cavity 331 and the air outlet cavity 332. The fan assembly 400 is installed in the air outlet cavity 332.

For example, the housing 300 of the fresh air module 200 may have a fresh air inlet 301 at its bottom, and the fresh air inlet 301 communicates with the air inlet cavity 331. The housing 300 may be provided with a fresh air outlet 302 at its top or front side or left or right side, and the fresh air outlet 302 communicates with the air outlet cavity 332. For example, the housing 300 may be provided with a fresh air inlet 301 at its bottom, which is open to the rear side of the fresh air module 200. The fresh air inlet 301 is communicated with the outdoor environment through a fresh air pipe 800, so that the air enters from the rear. The housing 300 may be provided with a fresh air outlet 302 at the front side thereof, so as to output air at the front side of the fresh air module 200.

Figure 3:
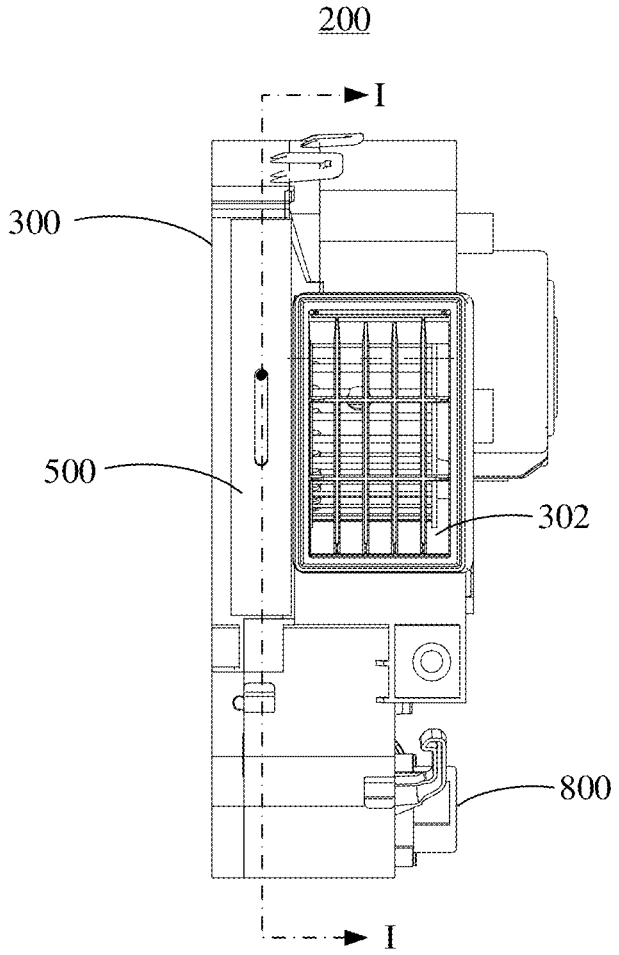
FIG. 3 is a front view of the fresh air module in FIG. 2.
Figure 4:
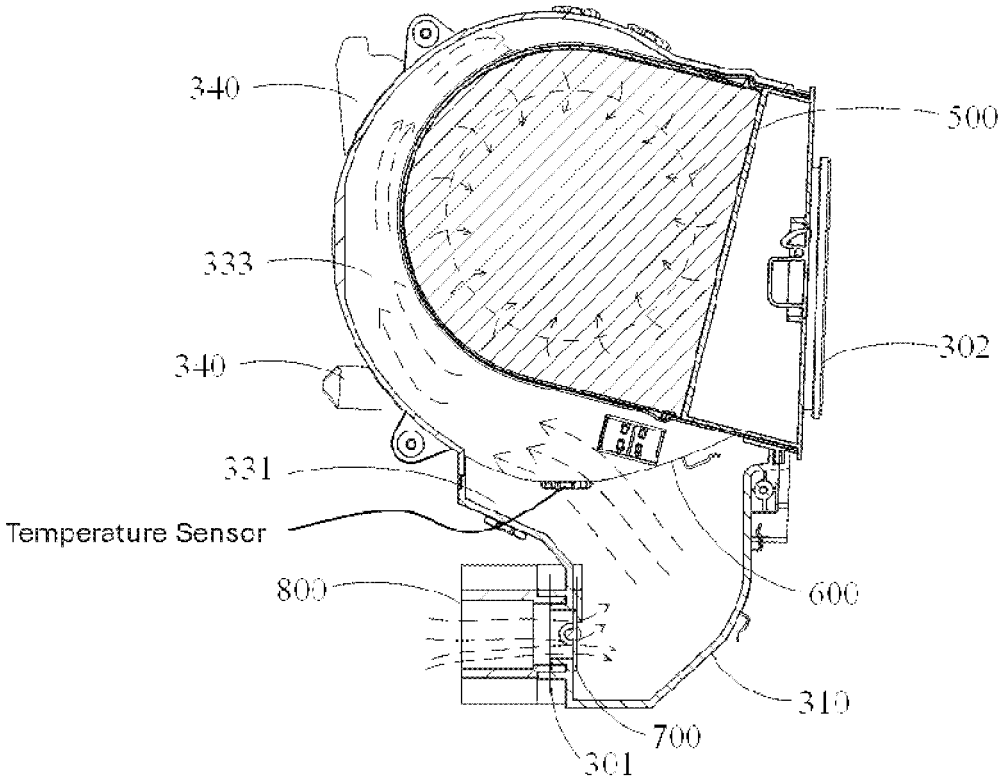
FIG. 4 is a cross-sectional view taken along line I-I in FIG. 3.

Referring to FIG. 3 to FIG. 5, when the fresh air module 200 is in operation, the fan assembly 400 is turned on, and the fresh air is driven to enter the air inlet cavity 331 of the fresh air duct 330 from the fresh air inlet 301 by the fan assembly 400, and then enters the air outlet cavity 332 through the ventilation hole 610 of the middle partition plate 600, and is moved to the fresh air outlet 302 by the fan assembly 400 in the air outlet cavity 332 along a radial direction of the fan assembly 400, and finally blows out from the fresh air outlet 302.

Since the middle partition plate 600 divides the fresh air duct 330 into an air inlet cavity 331 and an air outlet cavity 332, the air outlet cavity 332 is communicated through the ventilation hole 610 on the middle partition plate 600, which is equivalent to dividing the fresh air duct 330 into segments. Therefore, for the entire fresh air duct 330, the volume of the air outlet cavity 332 is smaller than that of the entire fresh air duct 330. Therefore, when the fan assembly 400 rotates in the air outlet cavity 332, the fan assembly 400 quickly sucks air from the ventilation hole 610 of the middle partition plate 600 and pushes it to the air outlet cavity 332, thus making the air pressure in the air outlet cavity 332 higher, and in turn increasing the rate at which the fan assembly 400 outputs the fresh air from the fresh air outlet 302 and greatly increasing the fresh air volume output from the fresh air module 200.

Figure 7:
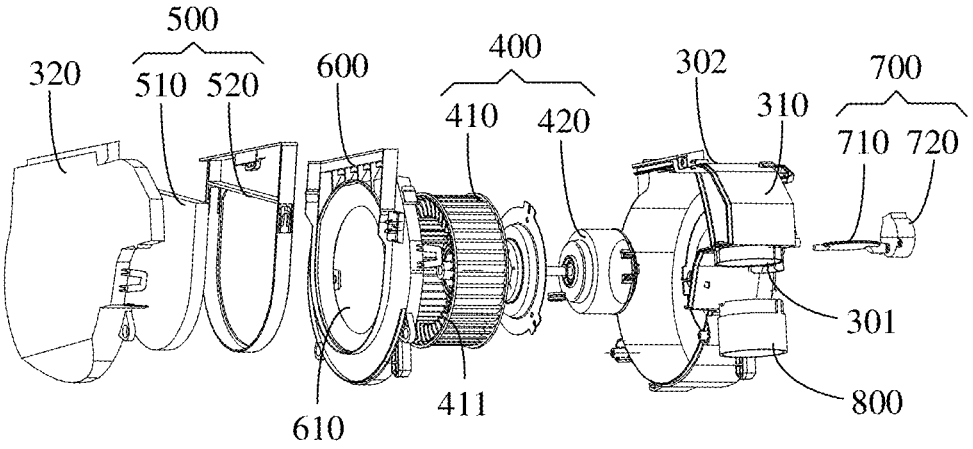
FIG. 7 is an exploded schematic view of the fresh air module in FIG. 3.

As for the structure of the purification assembly 500, there may be various design solutions, which are not limited herein. For example, but is not limited to, the purification assembly 500 includes a mounting frame 510 and a purification member 520 mounted on the mounting frame 510 (as shown in FIG. 7). The purification member 520 may be used to remove any one or more of air pollutants such as dust, fine particles, microorganisms, and organic volatile gases (e.g., formaldehyde) in the air. The type of the purification member 520 may be selected according to its function. The purification member 520 may be any one or two of an ordinary filter screen, a HEPA screen, a formaldehyde remover or an IFD filter. The purification member 520 may be any one or more of a primary-efficiency filter, a medium-efficiency filter and a high-efficiency filter.

According to the technical solution of this application, the middle partition plate 600 is arranged in the fresh air duct 330 of the fresh air module 200, so that the fresh air duct 330 is divided into the air inlet cavity 331 and the air outlet cavity 332, and the air inlet cavity 331 and the air outlet cavity 332 are communicated through the ventilation hole 610 on the middle partition plate 600, so that for the entire fresh air duct 330, the volume of the air outlet cavity 332 is smaller than that of the entire fresh air duct 330. Therefore, when the fan assembly 400 rotates in the air outlet cavity 332, the fan assembly 400 quickly sucks air from the ventilation hole 610 of the middle partition plate 600 and pushes it into the air outlet cavity 332, thus making the air pressure in the air outlet cavity 332 higher, and in turn increasing the rate at which the fan assembly 400 outputs the fresh air from the fresh air outlet 302 and greatly increasing the fresh air volume output from the fresh air module 200.

Figure 8:
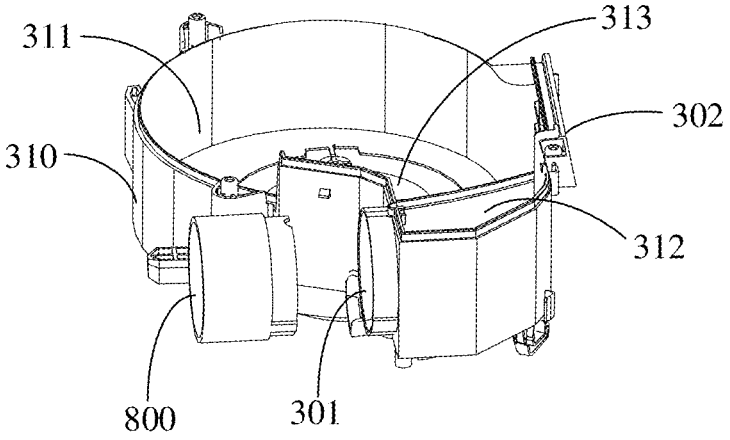
FIG. 8 is a schematic structural view of a bottom case in FIG. 7.

Referring to FIG. 5, FIG. 7 and FIG. 8, in an embodiment, the housing 300 includes a bottom case 310 and a cover that fits and covers the bottom case 310. In particular, the bottom case 310 is provided with a first cavity 311, and the middle partition plate 600 is installed at an opening of the first cavity 311 to cooperate with the first cavity 311 to form the air outlet cavity 332. In particular, the middle partition plate 600 is substantially matched with a shape of the opening of the first cavity 311. During assembling, the middle partition plate 600 is assembled at the opening of the first cavity 311, and then the cover 320 is covered on the bottom case 310 to surround the middle partition plate 600 between the bottom case 310 and the cover 320.

In an embodiment, the bottom case 310 is further provided with a second cavity 312 located at one side of the first cavity 311, and the air inlet cavity 331 is formed between the first cavity 311 and the cover 320. An air passage cavity 333 is formed between the middle partition plate 600 and the cover 320, and the air passage cavity 333 communicates the ventilation hole 610 of the middle partition plate 600 with the air inlet cavity 331.

For example, the cover 320 is covered on the bottom case 310, and in particular, a part of the cover 320 covers above the second cavity 312 of the bottom case 310, and cooperates with the second cavity 312 to form the air inlet cavity 331. When the fresh air module 200 is in operation, the airflow enters through the fresh air inlet, then enters the air outlet cavity 332 through the air inlet cavity 331, the air passage cavity 333 and the ventilation hole 610 of the middle partition plate 600, and finally blows out from the fresh air outlet 302.

As for the fixing means of the housing 300 and the middle partition plate 600, the middle partition plate 600 may be installed at the opening of the first cavity 311 of the bottom case 310, and then the middle partition plate 600 and the bottom case 310 may be snap-connected by a snap structure and/or connected into an integral piece by a screw structure. Then, the cover 320 is covered on the integral piece formed by connecting the bottom case 310 with the middle partition plate 600, and the cover 320 may be connected and fixed with the bottom case 310 and/or the middle partition plate 600 by any one or both of the snap structure and the screw structure.

Referring to FIG. 5, FIG. 7 and FIG. 8, in an embodiment, the fan assembly 400 is installed in the first cavity 311. The fan assembly 400 includes a centrifugal wind wheel 410 and a first motor 420. An end of the centrifugal wind wheel 410 is connected to the first motor 420, and the other end of the centrifugal wind wheel 410 forms an air inlet end and corresponds to the ventilation hole 610 of the middle partition plate 600. During the operation of the fresh air module 200, the airflow in the air inlet cavity 331 passes through the ventilation hole 610 of the middle partition plate 600, then directly enters the centrifugal wind wheel 410 from the air inlet end of the centrifugal wind wheel 410, and then is propelled by the centrifugal wind wheel 410 at a high speed, thus enhancing the air supply efficiency of the centrifugal wind wheel 410.

In the industry, the first motor 420 of the fan assembly 400 is usually installed on the bottom case 310 from the bottom surface of the bottom case 310 through a separately disposed motor cover. Therefore, the installation direction to install the first motor 420 is opposite to the assembling direction to assemble the centrifugal wind wheel 410, the middle partition plate 600 or the cover 320, and the assembling direction needs to be repeatedly adjusted during the assembly process, such as adjusting the direction of driving the screws. This assembling method is complicated and the assembling efficiency is low.

In view of this, in order to solve the above-mentioned technical problems, optionally, a bottom portion of the bottom case 310 has a motor installation cavity 313 in a direction away from the middle partition plate 600, and the motor installation cavity 313 has an opening facing the first cavity 311 for the first motor 420 to be installed. When the fresh air module 200 is being assembled, the first motor 420 may be installed into the motor installation cavity 313 of the bottom case 310 from the opening of the bottom case 310, and then the centrifugal wind wheel 410 is installed in the first cavity 311 of the bottom case 310 and connected with the first motor 420. That is, the assembling direction of the first motor 420 is the same as those of the centrifugal wind wheel 410, the middle partition plate 600, and the cover 320, and repeated adjustment of the assembling direction is not needed. For example, the screws may be driven from the forward direction, which may achieve rapid assembling.

Figure 6:
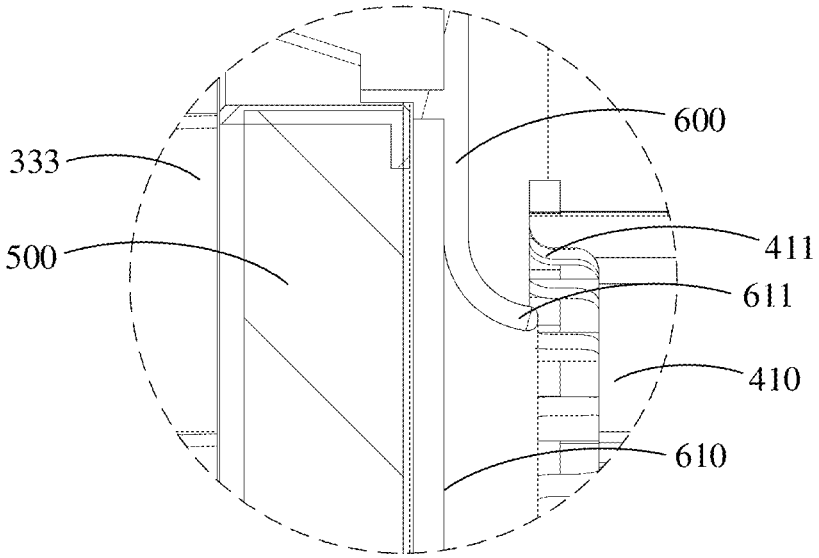
FIG. 6 is an enlarged view of portion A of FIG. 5.

Referring to FIGS. 5 to 7, in an embodiment, for the middle partition plate 600, the middle partition plate 600 is formed with a ventilation hole 610 in its central area to correspond to the air inlet end of the centrifugal wind wheel 410. A ventilation area of the ventilation hole 610 is substantially the same as or slightly smaller than an air inlet area of the air inlet end of the centrifugal wind wheel 410, such that most of the airflow passing through the ventilation hole 610 may enter the centrifugal wind wheel 410 to avoid the air volume loss caused by axial diffusion. Here, a ratio of the ventilation area of the ventilation hole 610 of the middle partition plate 600 to the side area of the middle partition plate 600 is not less than ¼ and not more than ¾, so as to ensure that the size of the ventilation hole 610 is substantially the same as or slightly smaller than the air inlet area of the air inlet end of the centrifugal wind wheel 410.

It is considered here that when the air flows from the air inlet cavity 331 to the ventilation hole 610 of the middle partition plate 600, the area for the air to flow is reduced, and the ventilation hole 610 has greater resistance to the airflow, so that it is difficult for the airflow to pass through the ventilation hole 610. Therefore, in order to solve this problem, optionally, the middle partition plate 600 may be provided with an air guide ring 611 at the periphery of the ventilation hole 610, and the air guide ring 611 extends from the periphery of the ventilation hole 610 toward the air inlet end of the centrifugal wind wheel 410 in a tapered shape.

For example, the air guide ring 611 is protruded from the periphery of the ventilation hole 610 toward the air inlet end of the centrifugal wind wheel 410, and the diameter of the air guide ring 611 is gradually reduced, so that the air guide ring 611 is arranged in a tapered shape. A flared end of the air guide ring 611 is correspondingly located at the ventilation hole 610, and the constricted end of the air guide ring 611 faces the air inlet end of the centrifugal wind wheel 410. The air guide ring 611 may reduce the resistance of the airflow passing through the ventilation hole 610, which helps to guide the airflow to accurately flow into the air inlet end of the centrifugal wind wheel 410 after passing through the ventilation hole 610, so as to prevent the airflow from diffusing at the air outlet side of the ventilation hole 610 and failing to enter the centrifugal wind wheel 410.

In an embodiment, the air inlet end of the centrifugal wind wheel 410 is provided with an air induction ring 411, the constricted end of the air guide ring 611 extends into the air induction ring 411, and a clearance gap is formed between an outer peripheral wall of the air guide ring 611 and an inner peripheral wall of the air induction ring 411 for the centrifugal wind wheel 410 to rotate.

For example, by extending the constricted end of the air guide ring 611 into the air induction ring 411 of the centrifugal wind wheel 410, the airflow guided by the air guide ring 611 may directly reach the inside of the centrifugal wind wheel 410 after being separated from the air guide ring 611, thus increasing the air intake volume of the centrifugal wind wheel 410, and in turn increasing the air volume and air supply efficiency of the centrifugal wind wheel 410. Since the constricted end of the air guide ring 611 extends into the air induction ring 411 of the centrifugal wind wheel 410, a clearance gap is provided between the outer peripheral wall of the air guide ring 611 and the inner peripheral wall of the air induction ring 411 in order to avoid the interference between the wind guide ring and the air induction ring, which may make the air induction ring 411 of the centrifugal wind wheel 410 rotate around the outer periphery of the air guide ring 611, thus ensuring that the wind guide ring and the air induction ring do not interfere each other during the rotation.

Referring to FIG. 3 and FIG. 4, based on any of the above embodiments, the fresh air module 200 further includes a temperature sensor, which is suitable for detecting the temperature of fresh air. In an embodiment, the windward surface of the middle partition plate 600 is provided with a sensor fixing member 620, which is located at a position of the middle partition plate 600 close to the front air inlet cavity 331, and is suitable for fixing the temperature sensor. When the sensor fixing member 620 is used to fix the temperature sensor, the temperature sensor may be positioned closer to the fresh air inlet 301, which is beneficial to accurately detecting the temperature of fresh air.

As for the structural type of the sensor fixing member 620, the sensor fixing member 620 may be a wire clamp for clamping and fixing the temperature sensor, a limiting slot for limiting the movement of the temperature sensor, or a fixing sleeve for the temperature sensor to pass through. It may be selected according to the cost and difficulty of design, which is not limited here.

Referring to FIGS. 5 to 7, based on any of the above embodiments, the fresh air module 200 further includes a purification assembly 500, which is of a pull-push type and installed on the middle partition plate 600 along an inner-outer direction of the housing 300, and is located at the air inlet side of the ventilation hole 610 of the middle partition plate 600.

For example, the housing 300 is provided with an installation opening at one side of the fresh air outlet 302, and the installation opening is arranged in a strip shape and extends in the same direction as one side of the fresh air outlet 302. The purification assembly 500 is installed on the middle partition plate 600 and drawable from the installation opening. The user may draw out the purification assembly 500 from the installation opening (in the direction indicated by "F" in FIG. 4) for cleaning or replacement. The purification assembly 500 may also be pushed into the air inlet side of the ventilation hole 610 of the middle partition plate 600 from the installation opening, so as to purify the airflow from the air inlet cavity 331 to the air outlet cavity 332 through the ventilation hole 610 and remove the pollutants in the air.

In addition, the air inlet end of the fan assembly 400 corresponds to the ventilation hole 610, so the purification assembly 500 corresponds to the air inlet end of the fan assembly 400. The airflow in the air inlet cavity 331 is first purified into clean fresh air by the purification assembly 500, and then the clean fresh air enters the air inlet end of the fan assembly 400 from the ventilation hole 610, and is finally blown out by the fan assembly 400 along the radial direction of the fan assembly 400. Compared with the air inlet cavity 331, the air passage cavity 333 between the middle partition plate 600 and the cover 320 have a larger space, so that a purification surface of the purification assembly 500 through which the air passes for purification may be designed to be larger according to the size of the ventilation hole 610, thereby increasing the air purification efficiency of the purification assembly 500. Since the purification assembly 500 is designed to be larger, the air volume that may be purified by the purification assembly 500 is correspondingly increased, thus prolonging the life of the purification assembly 500 and taking a longer period before a new purification assembly 500 is needed.

Referring to FIG. 7, based on any of the above embodiments, the fresh air module 200 further includes a valve assembly 700 installed at the fresh air inlet 301, and the valve assembly 700 includes a fresh air door 710 which is rotatable relative to the fresh air inlet 301, and a second motor 720 connected with the fresh air door 710. The second motor 720 drives the fresh air door 710 to turn over, so that the fresh air door 710 opens or closes the fresh air inlet 301. For example, in winter, when the temperature of outdoor environment is low, the fresh air inlet 301 may be closed by the fresh air door to prevent the outdoor cold air from entering and freezing the fresh air module 200 or entering the indoor environment through the fresh air module 200.

Referring to FIGS. 1 and 2, the present application also provides an air conditioner 100, which includes a casing 110 and a fresh air module 200 installed in the casing 110. The detained structure of the fresh air module 200 can be referred to the above embodiments. Since the air conditioner 100 adopts all the technical solutions of all the above embodiments, it has at least all the beneficial effects brought by the technical solutions of the above embodiments, and will not be described here again. The air conditioner 100 can be any one of an indoor unit of a wall-mounted air conditioner, an indoor unit of a cabinet air conditioner, an air machine, an indoor unit of a ceiling-type air conditioner, or a mobile air conditioner. Hereafter, the description will be given by taking the air conditioner 100 as the indoor unit of the wall-mounted air conditioner as an example.

In an embodiment, the casing 110 is provided with an air inlet 101, a first air outlet 102 and a second air outlet 103. In particular, the air inlet 101 is communicated with the first air outlet 102. The fresh air module 200 is installed in the casing 110, the air inlet cavity 331 of the fresh air module 200 is suitable for communicating with the outdoor environment through the fresh air pipe 800, and the air outlet cavity 332 of the fresh air module 200 is suitable for communicating with the second air outlet 103. Thus, the air conditioner 100 has an indoor air circulation mode and a fresh air mode.

In the indoor air circulation mode, the air from indoor environment enters the casing 110 through the air inlet 101, cold air or hot air is generated after the heat exchange by the heat exchange assembly inside the casing 110, and then the cold air or hot air is blown back to the indoor environment through the first air outlet 102 to achieve the indoor air circulation; and in the fresh air mode, the air from outdoor environment enters the fresh air module 200 through the fresh air pipe 800, and clean fresh air is generated after purification by the purification assembly of the fresh air module. The fresh air is blown from the fresh air outlet 302 of the fresh air module 200 to the second air outlet 103 of the casing 110, and finally blown from the second air outlet 103 to the indoor environment, so as to supplement fresh air for the indoor environment.

In an embodiment, the casing 110 includes a chassis 111, a frame 112 and a panel 113. The fresh air module 200 is installed at an end of the chassis 111, and the fresh air outlet 302 of the fresh air module 200 faces toward the panel 113. An end of the panel 113 is provided with a second air outlet 103, so that the air conditioner 100 may send fresh air forward, and so that the fresh air may accurately reach the position where the user is located.

In addition, in order to avoid fresh air from being blown directly to the user, optionally, the second air outlet 103 may be composed of a plurality of micro-pores penetrating through the panel 113, so that the airflow is broken into strands of smaller filament airflow after the fresh air is blown out from the plurality of micro-pores, the wind speed is reduced, the airflow becomes soft and will not be blown directly to the user, thus avoiding causing discomfort to the user.

To facilitate the installation of the fresh air module 200, an insertion part 340 is formed at the bottom and/or back of the housing 300 of the fresh air module 200 (the insertion part 340 may be seen in FIG. 4), and a fixing part 350 is formed at the front and/or top of the housing 300 (the fixing part 350 may be seen in FIG. 2). The chassis of the air conditioner is provided with a insertion slot for the insertion part 340 to be inserted correspondingly, and a connecting part for the fixing part 350 to be connected and fixed. During the installation, the fresh air module 200 is placed in the chassis, and then the insertion part 340 of the fresh air module 200 is inserted and connected with the insertion slot of the chassis to position the fresh air module 200 on the chassis. Then, the fixing part 350 of the fresh air module 200 and the connecting part of the chassis are connected through connectors (such as screws), so that the fresh air module 200 is fixed on the chassis, and the installation of the fresh air module 200 is completed.

The above embodiments are only optional or exemplary embodiments of this application, and do not limit the protection scope of this application. All equivalent changes made by using the contents of the specification and drawings of this application, or direct/indirect application in other related technical fields under the concept of this application are included in the protection scope of this application.

What is claimed is:

1. A fresh air module comprising:

a housing defining a fresh air duct, wherein the fresh air duct comprises an air inlet cavity and an air outlet cavity;

a middle partition plate in the fresh air duct, wherein the middle partition plate is located between the air inlet cavity and the air outlet cavity and is provided with a ventilation hole communicating the air inlet cavity and the air outlet cavity; and a fan assembly in the air outlet cavity, the fan assembly comprising a centrifugal wind wheel;

wherein:

the middle partition plate is provided with an air guide ring at a periphery of the ventilation hole;

an air inlet end of the centrifugal wind wheel is provided with an air induction ring, a constricted end of the air guide ring is extended into the air induction ring.

2. The fresh air module according to claim 1, wherein:

the housing comprises a bottom case and a cover that fits and covers the bottom case, and the bottom case defines a first cavity, wherein the middle partition plate is provided at an opening of the first cavity to cooperate with the first cavity to form the air outlet cavity.

3. The fresh air module according to claim 2, wherein:

the bottom case further defines a second cavity located at one side of the first cavity, and the air inlet cavity is formed between the first cavity and the cover, and the fresh air duct further comprises an air passage cavity between the middle partition plate and the cover, and the ventilation hole of the middle partition plate is communicated with the air inlet cavity by the air passage cavity.

4. The fresh air module according to claim 3, wherein:

a side wall of the bottom case corresponding to the first cavity is provided with a fresh air outlet, and the fresh air outlet is configured to output air forwardly, and a side wall of the bottom case corresponding to the second cavity is provided with a fresh air inlet, and the fresh air inlet is configured to intake air rearwardly.

5. The fresh air module according to claim 4, further comprising a valve assembly, wherein the valve assembly comprises a fresh air door rotatably provided at the fresh air inlet, and a second motor connected with the fresh air door, and wherein the second motor is configured to drive the fresh air door to turn over to open or close the fresh air inlet.

6. The fresh air module according to claim 2, wherein:

the fan assembly is provided in the first cavity and further comprises a first motor, and one end of the centrifugal wind wheel is connected with the first motor, and another end of the centrifugal wind wheel forms an air inlet end and corresponds to the ventilation hole of the middle partition plate.

7. The fresh air module according to claim 6, wherein:

the air guide ring is extended from the periphery of the ventilation hole toward the air inlet end of the centrifugal wind wheel in a tapered shape.

8. The fresh air module according to claim 7, wherein:

a clearance gap is formed between an outer peripheral wall of the air guide ring and an inner peripheral wall of the air induction ring for the centrifugal wind wheel to rotate.

9. The fresh air module according to claim 6, wherein:

a bottom portion of the bottom case has a motor installation cavity in a direction away from the middle partition plate, and the motor installation cavity is opened toward the first cavity for the first motor to be installed.

10. The fresh air module according to claim 6, wherein:

the middle partition plate is configured to form the ventilation hole in a central area of the middle partition plate, to correspond to the air inlet end of the centrifugal wind wheel, and a ratio of a ventilation face area of the ventilation hole of the middle partition plate to a side face area of the middle partition plate is not less than ¼ and not more than ¾.

11. The fresh air module according to claim 2, further comprising a temperature sensor, wherein the temperature sensor is located at a position on a windward surface of the middle partition plate close to a front air inlet cavity.

12. The fresh air module according to claim 1, further comprising a purification assembly, wherein the purification assembly is provided on the middle partition plate in a drawable manner along an inner-outer direction of the housing and is located at an air inlet side of the ventilation hole of the middle partition plate.

13. An air conditioner comprising:

a casing provided with an air inlet, a first air outlet and a second air outlet, wherein the air inlet is communicated with the first air outlet; and a fresh air module according to claim 1, wherein the fresh air module is provided in the casing, the air inlet cavity of the fresh air module is configured to communicate with outdoor environment through a fresh air pipe, and the air outlet cavity of the fresh air module is configured to communicate with the second air outlet.

14. The air conditioner according to claim 13, wherein the air conditioner comprises at least one of an indoor unit of a wall-mounted air conditioner, an indoor unit of a cabinet air conditioner, an air machine, an indoor unit of a ceiling-type air conditioner, or a mobile air conditioner.

15. The air conditioner according to claim 14, wherein:

the air conditioner comprises an indoor unit of a wall-mounted air conditioner;

the casing of the wall-mounted air conditioner indoor unit comprises a chassis, a frame and a panel, and the fresh air module is provided at an end of the chassis, and an end of the panel is provided with the second air outlet.

* * * * *